US011135845B2

(12) United States Patent
Andou et al.

(10) Patent No.: US 11,135,845 B2
(45) Date of Patent: Oct. 5, 2021

(54) LIQUID DISCHARGE HEAD, LIQUID DISCHARGE DEVICE, AND LIQUID DISCHARGE APPARATUS

(71) Applicant: Ricoh Company, Ltd., Tokyo (JP)

(72) Inventors: Shiomi Andou, Kanagawa (JP); Takahiro Yoshida, Kanagawa (JP); Takayuki Nakai, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 14 days.

(21) Appl. No.: 16/847,827

(22) Filed: Apr. 14, 2020

(65) Prior Publication Data

US 2020/0331262 A1 Oct. 22, 2020

(30) Foreign Application Priority Data

Apr. 18, 2019 (JP) ..... JP2019-079633

(51) Int. Cl.
*B41J 2/14* (2006.01)
*B41J 2/175* (2006.01)

(52) U.S. Cl.
CPC ..... *B41J 2/1433* (2013.01); *B41J 2/14201* (2013.01); *B41J 2/175* (2013.01); *B41J 2002/14306* (2013.01)

(58) Field of Classification Search
CPC ..... B41J 2/1433; B41J 2/14201; B41J 2002/14306; B41J 2/175
USPC ..... 347/20, 40, 44, 47, 54, 56, 63, 65, 68
See application file for complete search history.

(56) References Cited

U.S. PATENT DOCUMENTS

| | | | |
|---|---|---|---|
| 9,375,925 | B2 | 6/2016 | Shimizu et al. |
| 9,427,968 | B2 | 8/2016 | Kohda et al. |
| 9,815,285 | B2 | 11/2017 | Otome et al. |
| 10,005,281 | B2 | 6/2018 | Yoshida et al. |
| 10,160,216 | B2 | 12/2018 | Nakai et al. |
| 10,160,226 | B2 | 12/2018 | Kohda et al. |
| 10,179,452 | B2 | 1/2019 | Iwama et al. |
| 10,226,939 | B2 * | 3/2019 | Sawase ..... B41J 2/14451 |
| 10,399,355 | B2 | 9/2019 | Nakai et al. |
| 10,538,101 | B2 | 1/2020 | Kohda et al. |
| 2020/0094573 | A1 | 3/2020 | Kohda et al. |
| 2020/0094595 | A1 | 3/2020 | Iwama et al. |

FOREIGN PATENT DOCUMENTS

JP 2014-051079 3/2014

* cited by examiner

*Primary Examiner* — An H Do
(74) *Attorney, Agent, or Firm* — Xsensus LLP

(57) ABSTRACT

A liquid discharge head includes a plurality of nozzles to discharge liquid, a plurality of pressure chambers communicating with the nozzles, a plurality of individual flow paths communicating with the plurality of pressure chambers, and a common flow path communicating with the plurality of individual flow paths. Further, each individual flow path includes a first flow path portion and a second flow path portion each having a fluid resistance higher than a fluid resistance of a pressure chamber of the plurality of pressure chambers that communicates with the individual flow path, and a third flow path portion disposed between the first flow path portion and the second flow path portion, the third flow path portion having a fluid resistance lower than the fluid resistance of the first flow path portion and the third resistance of the second flow path portion.

19 Claims, 11 Drawing Sheets

LIQUID DISCHARGE HEAD, LIQUID DISCHARGE DEVICE, AND LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2019-079633, filed on Apr. 18, 2019, in the Japan Patent Office, the entire disclosure of which is hereby incorporated by reference herein.

BACKGROUND

Technical Field

The present disclosure relates to a liquid discharge head, a liquid discharge device, and a liquid discharge apparatus.

Related Art

The ejection characteristics of the liquid ejection head change due to residual vibration generated during ejection of a liquid. Japanese Publication No. JP2014-051079 discloses a method in which a part of a wall surface of a common liquid chamber is formed of a thin film portion, and the thin film portion attenuates pressure vibration in the common liquid chamber.

SUMMARY

A liquid discharge head includes (1) a plurality of nozzles to discharge liquid; (2) a plurality of pressure chambers respectively communicating with the plurality of nozzles; (3) a plurality of individual flow paths respectively communicating with the plurality of pressure chambers; and (4) a common flow path communicating with the plurality of individual flow paths. Further, each individual flow path includes a first flow path portion and a second flow path portion each having a fluid resistance higher than a fluid resistance of a pressure chamber of the plurality of pressure chambers that communicates with the individual flow path, and a third flow path portion disposed between the first flow path portion and the second flow path portion, the third flow path portion having a fluid resistance lower than the fluid resistance of the first flow path portion and the third resistance of the second flow path portion.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
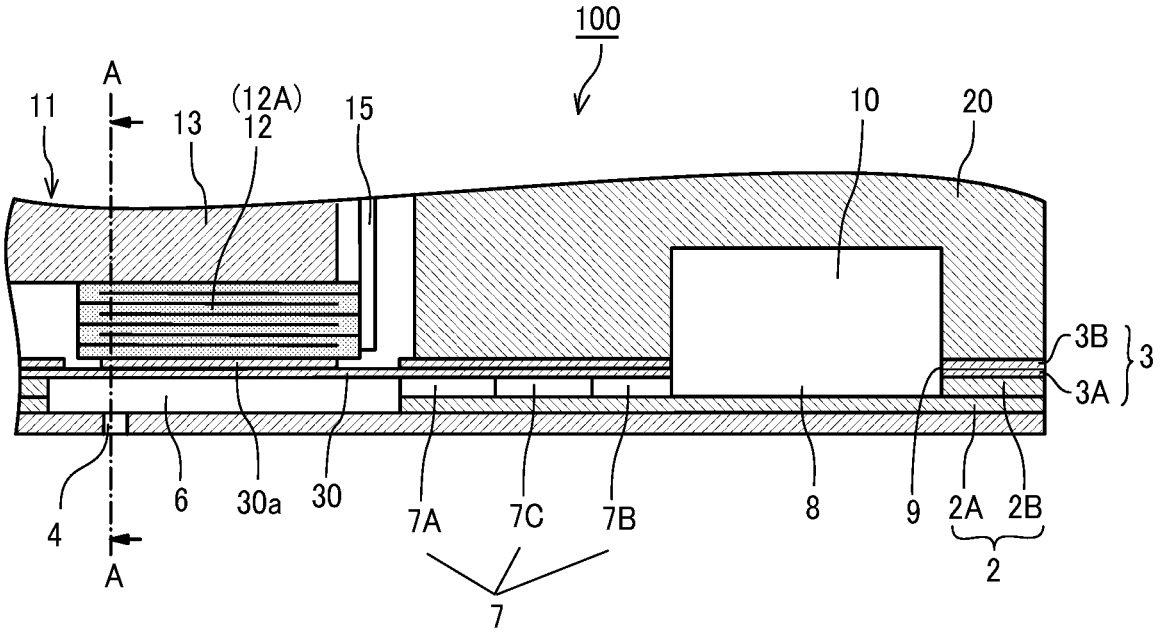
FIG. 1 is a cross-sectional view along a direction orthogonal to the nozzle arrangement direction of the liquid discharge head according to a first embodiment.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in an analogous manner, and achieve similar results.

Although the embodiments are described with technical limitations with reference to the attached drawings, such description is not intended to limit the scope of the disclosure and all the components or elements described in the embodiments of this disclosure are not necessarily indispensable. As used herein, the singular forms "a," "an," and "the" are intended to include the plural forms as well, unless the context clearly indicates otherwise.

Hereinafter, a liquid discharge head, a liquid discharge device, a liquid discharge apparatus, and a method for manufacturing a liquid discharge head according to the present disclosure is described with reference to the drawings. Note that the present disclosure is not limited to the following embodiments and may cover other embodiments. The following embodiments may be modified by, e.g., addition, modification, or omission within the scope that would be obvious to one skilled in the art. Any aspects having advantages as described for the following embodiments according to the present disclosure are included within the scope of the present disclosure.

Figure 2:
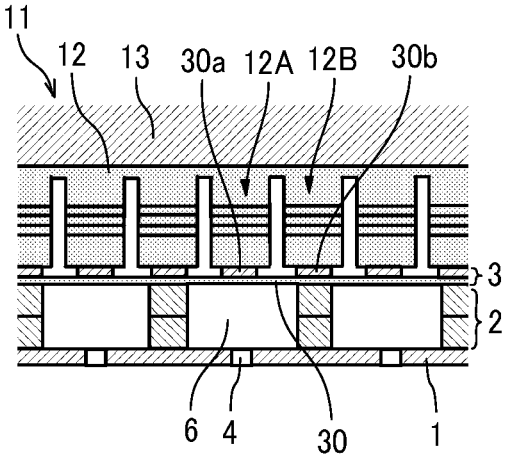
FIG. 2 is a cross-sectional view along the nozzle arrangement direction according to the first embodiment.

A first embodiment of the present disclosure will be described with reference to the figures. FIG. 1 is an explanatory sectional view along a direction (longitudinal direction of a pressure chamber) orthogonal to a nozzle arrangement direction of the liquid discharge head according to the first embodiment, and FIG. 2 is an explanatory sectional view along the nozzle arrangement direction.

The liquid ejection head 100 is configured by laminating and bonding a nozzle plate 1, a flow path plate 2 (individual flow path member), and a diaphragm member 3 (wall surface member). In addition, the liquid ejection head 100 includes a piezoelectric actuator 11 that displaces a vibration area (diaphragm) 30 of the vibration plate member 3 and a common flow path member 20 that is also a frame member of the head.

The nozzle plate 1 has a plurality of nozzles 4 for discharging liquid.

The flow path plate 2 forms a pressure chamber 6, an individual supply flow path 7, and an intermediate supply flow path 8. The pressure chamber 6 communicates with the plurality of nozzles 4. The individual supply flow paths 7 are individual flow paths that communicate with the respective pressure chambers 6. The intermediate supply flow path 8 is a liquid introduction unit that communicates with one or more (one in the present embodiment) individual supply flow paths 7.

The diaphragm member 3 has a plurality of displaceable diaphragms (vibration regions) 30 that form the wall surfaces of the pressure chambers 6 of the flow path plate 2. The diaphragm member 3 has a two-layer structure (not limited), and includes a first layer 3A forming a thin portion from the side of the flow path plate 2 to the opposite side, and a second layer 3B forming a thick portion.

The first layer 3A, which is a thin portion, forms a deformable vibration region 30 in a portion corresponding to the pressure chamber 6. In the vibration region 30, a second layer 3B forms a convex portion 30*a*, which is a thick portion bonded to the piezoelectric actuator 11.

The piezoelectric actuator 11 including an electromechanical transducer and is arranged on the side of the diaphragm member 3 opposite to the pressure chamber 6. The piezoelectric actuator 11 is a driving means (actuator means, pressure generating means) for deforming the vibration area 30 of the diaphragm member 3.

The piezoelectric actuator 11 is formed by subjecting a piezoelectric member bonded on the base member 13 to groove processing by half-cut dicing. Accordingly, the piezoelectric actuator 11 has a comb-like shape with a predetermined number of columnar piezoelectric elements 12 at predetermined intervals in the nozzle arrangement direction.

Further, the piezoelectric element 12 is bonded to the convex portion 30*a*, which is a thick portion formed in the vibration region 30 of the diaphragm member 3.

A driving piezo element 12A is located at a position corresponding to the pressure chamber 6, and a non-driving piezo element 12B is located at a position corresponding to a wall constituting the pressure chamber 6. The non-driving piezo element 12B include a convex portion 30*b*.

The piezoelectric element 12 is obtained by alternately stacking piezoelectric layers and internal electrodes. In the piezoelectric element 12, the internal electrodes are respectively drawn out to the end faces and connected to external electrodes (end face electrodes), and a flexible wiring member 15 is connected to the external electrodes.

The common flow path member 20 forms a common supply flow path 10 communicating with the plurality of pressure chambers 6. The common supply passage 10 communicates with the intermediate supply passage 8 and communicates with the individual supply passage 7 via the intermediate supply passage 8. The intermediate supply channel 8 serves as a liquid introduction unit via an opening 9 provided in the diaphragm member 3.

In the liquid ejection head 100, for example, the piezoelectric element 12 contracts by lowering the voltage applied to the piezoelectric element 12 from a reference potential (intermediate potential). Thereby, the vibration area 30 of the diaphragm member 3 is pulled, and the volume of the pressure chamber 6 expands. Then, the liquid flows into the pressure chamber 6.

Thereafter, by increasing the voltage applied to the piezoelectric element 12, the piezoelectric element 12 extends in the stacking direction. Then, the vibration area 30 of the vibration plate member 3 is deformed in the direction toward the nozzle 4 to reduce the volume of the pressure chamber 6. Thus, the liquid in the pressure chamber 6 is pressurized, and the liquid is discharged from the nozzle 4.

Figure 3:
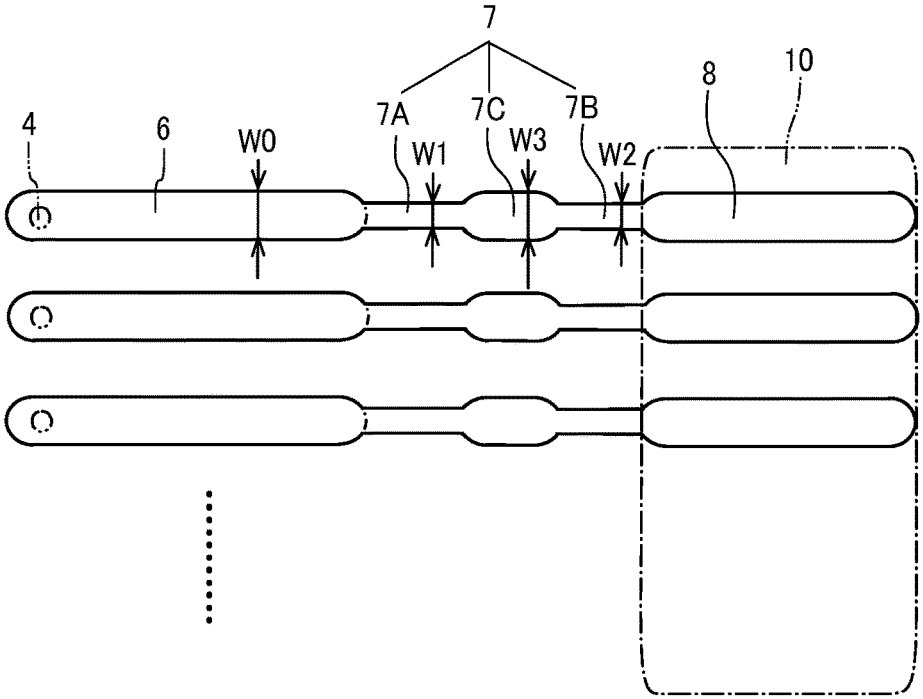
FIG. 3 is a top view of a flow-path structure according to the first embodiment.

Next, the channel configuration of the individual supply channel 7 will be described with reference to FIG. 3, which is a plan view of the flow path configuration in the first embodiment.

In the present embodiment, the individual supply channel 7, which is an individual channel, includes a first channel portion 7A, a second channel portion 7B, and a third channel portion 7C. The fluid resistance of the first channel portion 7A and the second channel portion 7B is higher than that of the pressure chamber 6. The third flow path portion 7C is disposed between the first flow path portion 7A and the second flow path portion 7B. The fluid resistance of the third flow path portion 7C is lower than the fluid resistance of the first flow path portion 7A and the second flow path portion 7B.

The first flow path portion 7A is connected to the pressure chamber 6. The second flow path portion 7B is connected to the intermediate supply flow path 8 (on the common supply flow path 10 side). The third flow path portion 7C is connected to the upstream of the first flow path portion 7A and the downstream of the second flow path portion 7B, respectively.

The fluid resistance of the first flow path portion 7A and the fluid resistance of the second flow path portion 7B can be the same or different.

In the present embodiment, the flow path length of the first flow path portion 7A is longer than the flow path length of the second flow path portion 7B. Thus, the fluid resistance of the first flow path portion 7A is higher than the fluid resistance of the second flow path portion 7B.

Further, the widths (in the nozzle arrangement direction) W1 and W2 of the first flow path portion 7A and the second flow path portion 7B are smaller than the flow width W0 of the pressure chamber 6. Thus, the fluid resistance of the first flow path portion 7A and the second flow path portion 7B is higher than the fluid resistance of the pressure chamber 6.

In addition, the channel width W3 of the third channel portion 7C is wider than the channel widths W1 and W2 of the first channel portion 7A and the second channel portion 7B. Thus, the fluid resistance of the third flow path portion 7C is lower than the fluid resistance of the first flow path portion 7A and the second flow path portion 7B.

Figure 4:
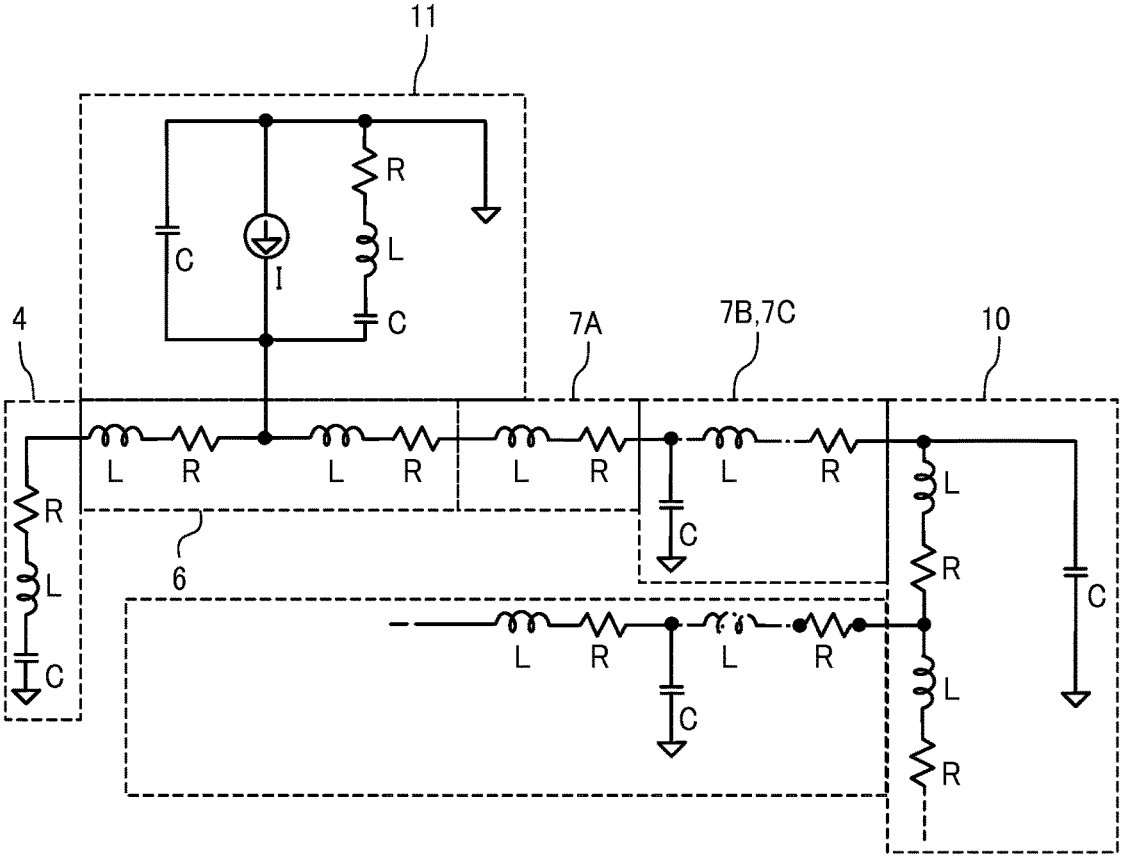
FIG. 4 is an equivalent circuit diagram of a flow path according to the first embodiment.

FIG. 4 shows an equivalent circuit of the flow path in the head 100 of the present embodiment.

As shown in FIG. 4, the first flow path portion 7A of the individual supply flow path 7 between the pressure chamber 6 and the common supply flow path 10 forms a series circuit of a resistance component R and an inductance L.

Further, the third flow path 7C and the second flow path 7B constitute a parallel circuit of a series circuit composed of R-L (resistance-inductance) and a capacitor C.

Thus, the pressure fluctuation caused when the liquid is discharged by pressurizing the pressure chamber 6 is attenuated by the parallel circuit functioning as a damping circuit, and the pressure fluctuation to the common supply channel 10 is suppressed. With a simple configuration like this, it is possible to suppress the pressure fluctuation to the common flow path and to reduce the fluctuation of the ejection characteristics.

Figure 5:
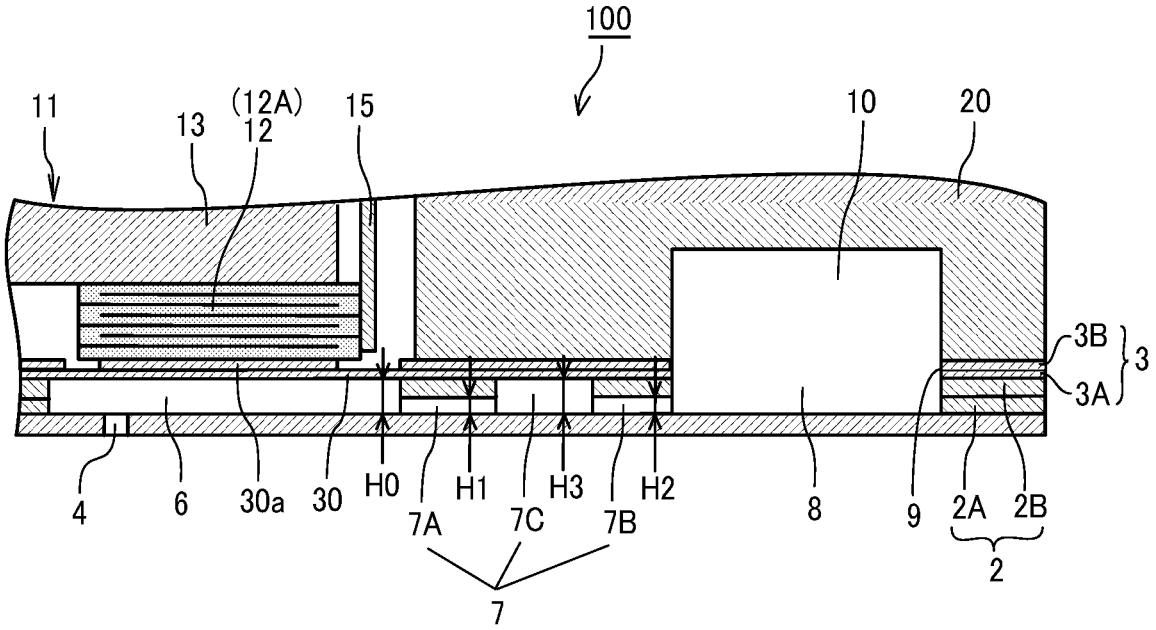
FIG. 5 is a cross-sectional view along a direction orthogonal to the nozzle arrangement direction of the liquid discharge head according to a second embodiment.
Figure 6:
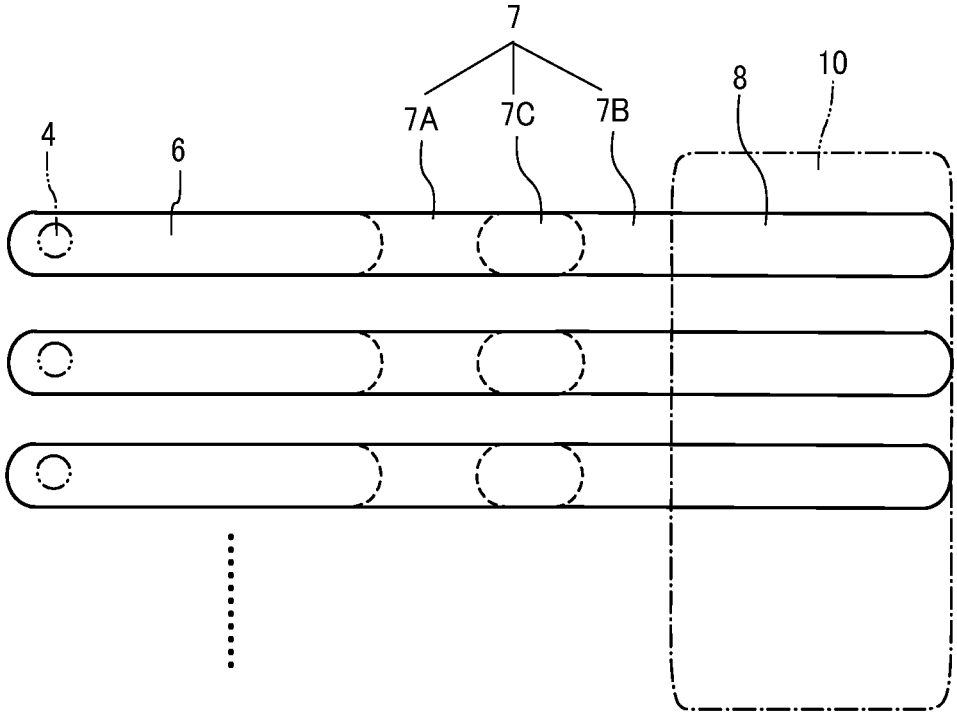
FIG. 6 is a top view of a flow-path structure according to the second embodiment.

Next, a second embodiment of the present disclosure will be described with reference to FIG. 5 and FIG. 6. FIG. 5 is a cross-sectional view along a direction orthogonal to the nozzle arrangement direction of the liquid discharge head according to the second embodiment. FIG. 6 is a top view of a flow-path structure according to the second embodiment.

In the present embodiment, widths of the pressure chamber 6, the first flow path 7A, the second flow path 7B, and the third flow path 7C are the same.

On the other hand, a flow path height H1 of the first flow path portion 7A and a flow path height H2 of the second flow path portion 7B are lower than a flow path height H0 of the pressure chamber 6.

Thus, each fluid resistance of the first flow path portion 7A and the second flow path portion 7B is higher than the fluid resistance of the pressure chamber 6.

A flow path height H3 of the third flow path portion 7C is higher than the flow path height H1 of the first flow path portion 7A and the flow path height H2 of the second flow path portion 7B.

Thus, the fluid resistance of the third flow path portion 7C is lower than the fluid resistance of the first flow path portion 7A and the second flow path portion 7B.

By changing the flow path height, the fluid resistance can be easily changed, and the head can be manufactured with a simple-shaped part.

Figure 7:
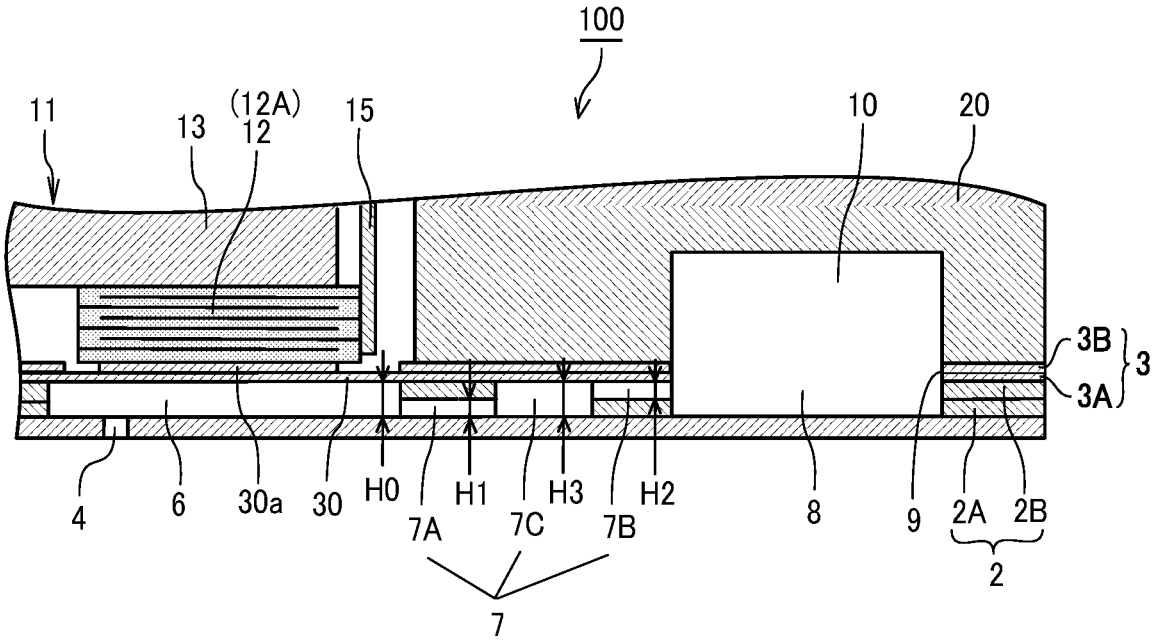
FIG. 7 is a cross-sectional view along a direction orthogonal to the nozzle arrangement direction of the liquid discharge head according to a third embodiment.
Figure 8:
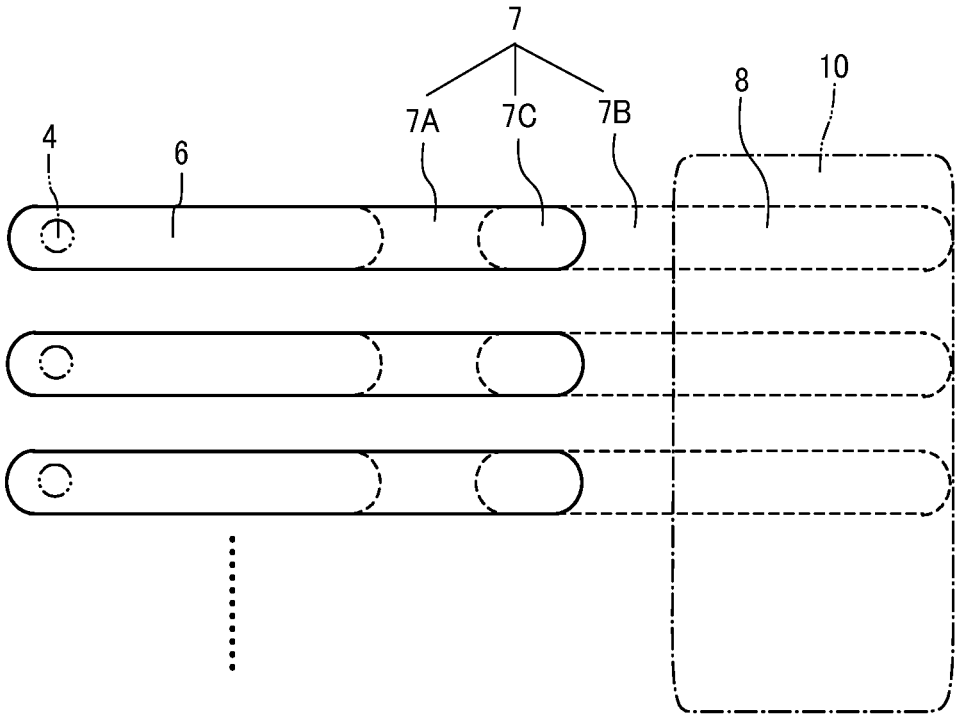
FIG. 8 is a top view of a flow-path structure according to the third embodiment.

Next, a third embodiment of the present disclosure will be described with reference to FIG. 7 and FIG. 8. FIG. 7 is a cross-sectional view along a direction orthogonal to the nozzle arrangement direction of the liquid discharge head according to the third embodiment. FIG. 8 is a top view of a flow-path structure according to the third embodiment.

In the present embodiment, similarly to the second embodiment, the fluid resistance is set by changing the flow path height.

The first flow path portion 7A and the second flow path portion 7B are arranged at different positions in the thickness direction of the flow path plate 2. Specifically, the flow path plate 2 is composed of a plate member 2A and a plat member 2B.

The plate member 2A forms the first flow path portion 7A and a part of the third flow path portion 7C. The plate member 2B forms the second flow path portion 7B and the remaining part of the third flow path portion 7C.

By arranging the positions of the first flow path portion 7A and the second flow path portion 7B at different positions in the thickness direction of the flow path plate 2, the flow of the liquid in the individual supply flow path 7 is not linear. Further, the damping effect of the pressure fluctuation can be enhanced.

Figure 9:
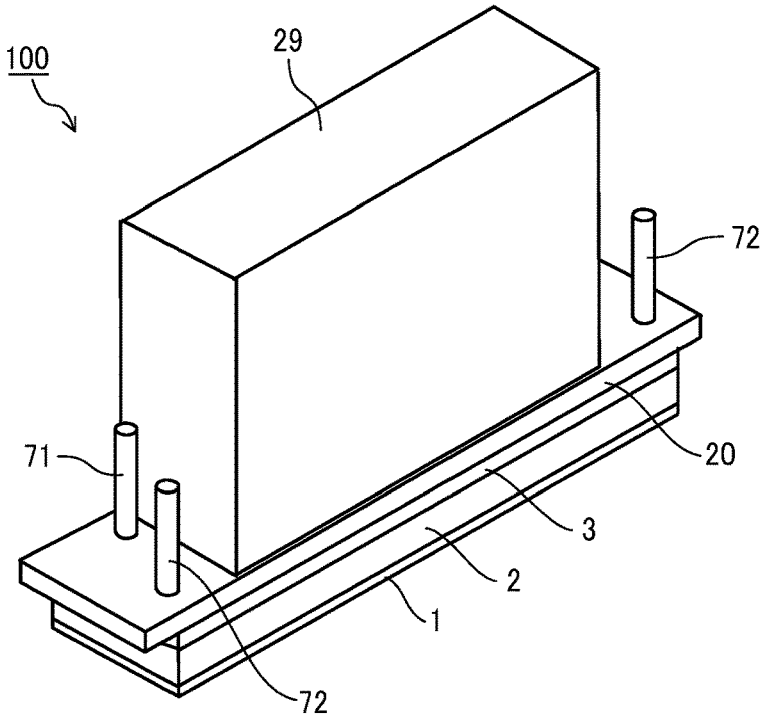
FIG. 9 is a perspective view of liquid discharge head according to a fourth embodiment.
Figure 10:
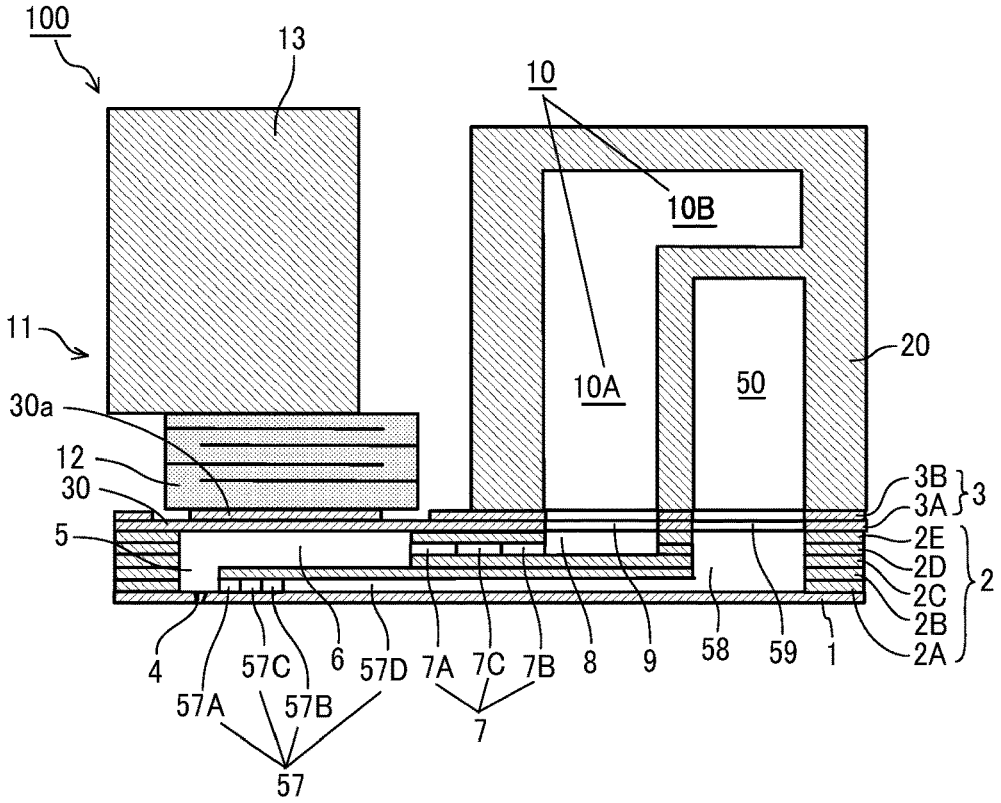
FIG. 10 is a cross-sectional view along a direction orthogonal to the nozzle arrangement direction of the liquid discharge head according to the fourth embodiment.

Next, a fourth embodiment of the present disclosure will be described with reference to FIG. 9 and FIG. 10. FIG. 9 is a perspective view of liquid discharge head according to the fourth embodiment. FIG. 10 is a cross-sectional view along a direction orthogonal to the nozzle arrangement direction of the liquid discharge head according to the fourth embodiment.

Hereinafter, the "liquid discharge head" is simply referred to as the "head". The head 100 includes a nozzle plate 1, a channel plate 2, and a diaphragm member 3, as a wall-face member, that are laminated one on another and bonded to each other. The head 100 includes a piezoelectric actuator 11 that displaces an oscillation region 30 (diaphragm) of the diaphragm member 3, a common channel member 20 doubling as a frame member of the head, and a cover member 29.

The flow path plate 2 forms a pressure chamber 6, an individual supply flow path 7, an intermediate supply flow path 8, and the like.

The pressure chamber 6 communicates with the plurality of nozzles 4 via the respective nozzle communication paths 5.

The individual supply flow passages 7 serve as a plurality of fluid resistance portions each communicating with the plurality of pressure chambers 6.

The intermediate supply flow path 8 serves as one or a plurality of liquid introduction sections communicating with two or more individual supply flow paths 7.

The fluid resistance of the first channel portion 7A and the second channel portion 7B is higher than that of the pressure chamber 6. The third flow path portion 7C is disposed between the first flow path portion 7A and the second flow path portion 7B. The fluid resistance of the third flow path portion 7C is lower than the fluid resistance of the first flow path portion 7A and the second flow path portion 7B.

The channel plate 2 is configured by laminating a plurality of plate members 2A to 2E, but is not limited to this.

Further, the flow path plate 2 forms an individual recovery flow path 57 and an intermediate recovery flow path 58.

The individual recovery flow path 57 is arranged along the surface direction of the flow path plate 2 that communicates with each of the plurality of pressure chambers 6 via the nozzle communication path 5. In addition, the individual recovery flow path 57 includes the first flow path portion 57A, the second flow path portion 57B, and the third flow path portion 57C. The channel width of the channel portion 57D disposed downstream of the second channel flow path portion 57B in the circulation direction is the same as the channel width of the third flow path portion 57C.

The intermediate recovery channel 58 serves as one or a plurality of liquid outlets communicating with two or more individual recovery channels 57.

The common flow path member 20 forms a common supply flow path 10 and a common recovery flow path 50. In this embodiment, the common supply channel 10 includes a channel portion 10A and a channel portion 10B. The flow path portion 10A is disposed so as to be adjacent to the common recovery flow path 50 in the nozzle arrangement direction. The flow path portion 10B is arranged so as not to be adjacent to the common recovery flow path 50.

The common supply passage 10 communicates with the intermediate supply passage 8 and communicates with the individual supply passage 7 via the intermediate supply passage 8. The intermediate supply flow path 8 is a liquid introduction section constituted by an opening 9 provided in the diaphragm member 3.

The common recovery channel 50 communicates with the intermediate recovery channel 58 and communicates with the individual recovery channel 57 via the intermediate recovery channel 58. The intermediate recovery flow path 58 is a liquid lead-out section configured by an opening 59 provided in the diaphragm member 3.

The common supply channel 10 communicates with the supply port 71, and the common collection channel 50 communicates with the collection port 72.

The other configuration of the diaphragm member 3 and the configuration of the piezoelectric actuator 11 are the same as those of the first embodiment.

The other configuration of the vibration plate member 3, the configuration of the piezoelectric actuator 11, the operation for discharging the liquid, and the like are the same as those in the first embodiment.

The liquid that is not discharged from the nozzle 4 passes through the nozzle 4 and is collected from the individual collection channel 57 to the common collection channel 50. Then, the liquid is supplied again from the common recovery flow path 50 to the common supply flow path 10 through an external circulation path.

Further, even when the liquid is not ejected from the nozzle 4, the liquid circulates to the common recovery flow path 50 via the common supply flow path 10 and the pressure chamber 6. Then, the liquid is supplied again to the common supply channel 10 through an external circulation path.

Further, in the present embodiment, it is possible to reduce the pressure fluctuation due to the liquid ejection with a simple configuration. Thus, it is possible to suppress the pressure fluctuation from reaching the common supply channel 10 and the common recovery channel 50.

Figure 11:
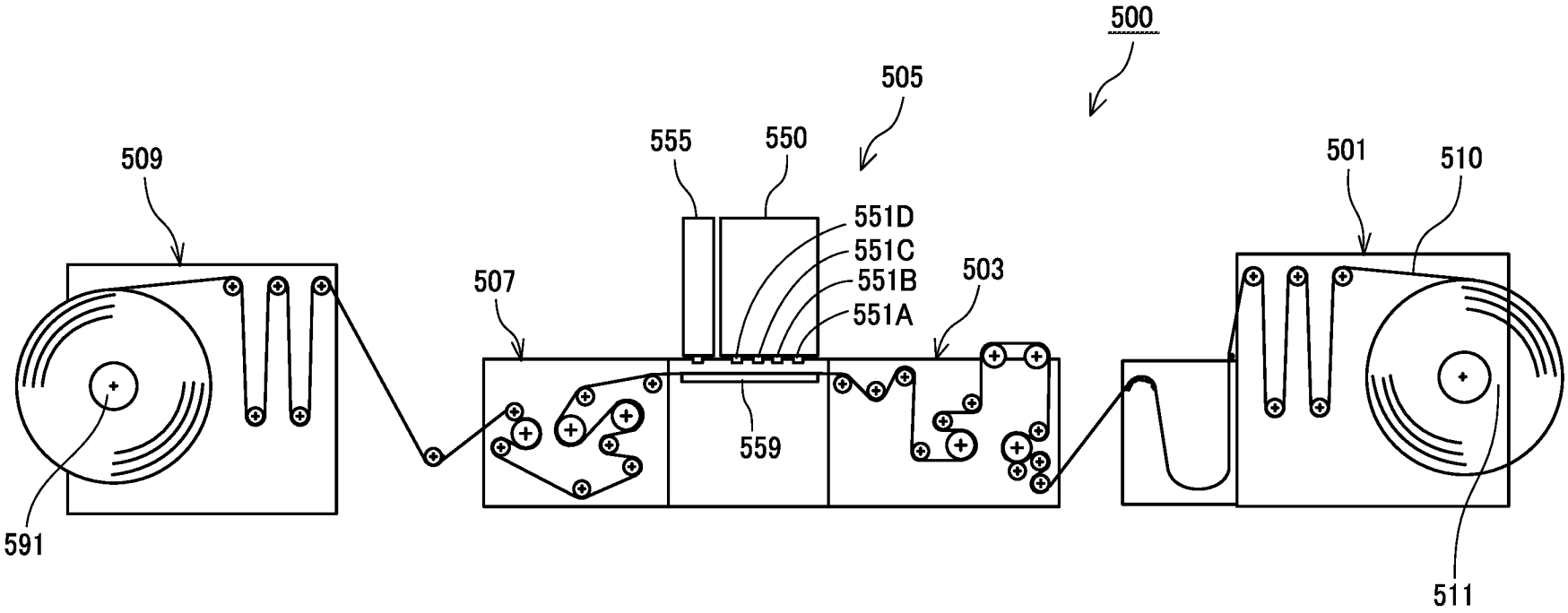
FIG. 11 is an explanatory schematic view of an exemplary liquid discharge apparatus according to the present disclosure.
Figure 12:
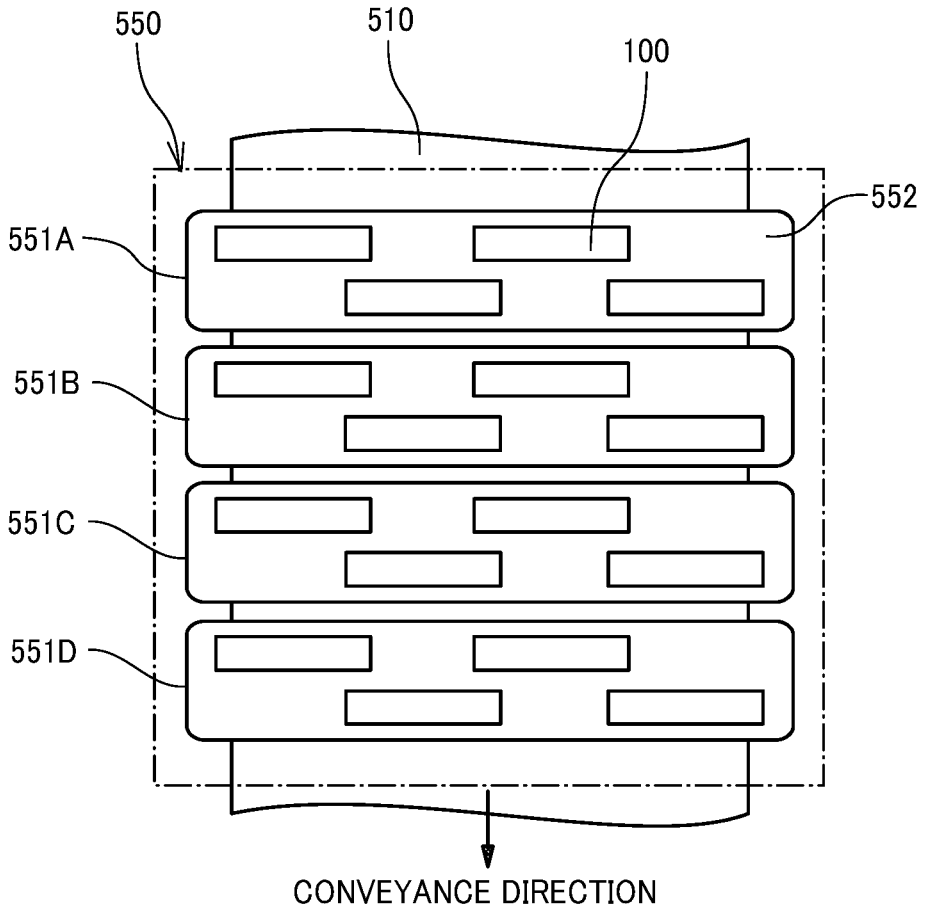
FIG. 12 is an explanatory plan view of an exemplary head unit of the liquid discharge apparatus.

Next, an exemplary liquid discharge apparatus according to the present disclosure, will be described with reference to FIGS. 11 and 12. FIG. 11 is an explanatory schematic view of the liquid discharge apparatus. FIG. 12 is an explanatory plan view of an exemplary head unit of the liquid discharge apparatus.

The printing apparatus 500 serving as the liquid discharge apparatus according to the present embodiment includes a feeder 501 to feed a continuous medium 510, a guide conveyor 503 to guide and convey the continuous medium 510, fed from the feeder 501, to a printing unit 505, the printing unit 505 to discharge liquid onto the continuous medium 510 to form an image on the continuous medium 510, a dryer unit 507 to dry the continuous medium 510, and an ejector 509 to eject the continuous medium 510.

The continuous medium 510 is fed from a root winding roller 511 of the feeder 501, guided and conveyed with rollers of the feeder 501, the guide conveyor 503, the dryer unit 507, and the ejector 509, and wound around a winding roller 591 of the ejector 509.

In the printing unit 505, the continuous medium 510 is conveyed opposite a first head unit 550 and a second head unit 555 on a conveyance guide 559. The first head unit 550 discharges liquid to form an image on the continuous medium 510. Post-treatment is performed on the continuous medium 510 with treatment liquid discharged from the second head unit 555.

Here, the first head unit 550 includes, for example, four-color full-line head arrays 551A, 551B, 551C, and 551D (hereinafter, collectively referred to as "head arrays 551" unless colors are distinguished) from an upstream side in a feed direction of the continuous medium 510 (hereinafter, "medium feed direction").

The head arrays 551A, 551B, 551C, and 551D are liquid dischargers to discharge liquid of black (K), cyan (C), magenta (M), and yellow (Y), respectively, onto the continuous medium 510. Note that the number and types of color are not limited to the above-described four colors of K, C, M, and Y and may be any other suitable number and types.

In each head array 551, for example, as illustrated in FIG. 12, a plurality of heads 100 (also referred to as simply "heads") are arranged in a staggered manner on a base 552 to form the head array 551. Note that the configuration of the head array 551 is not limited to such a configuration.

Figure 13:
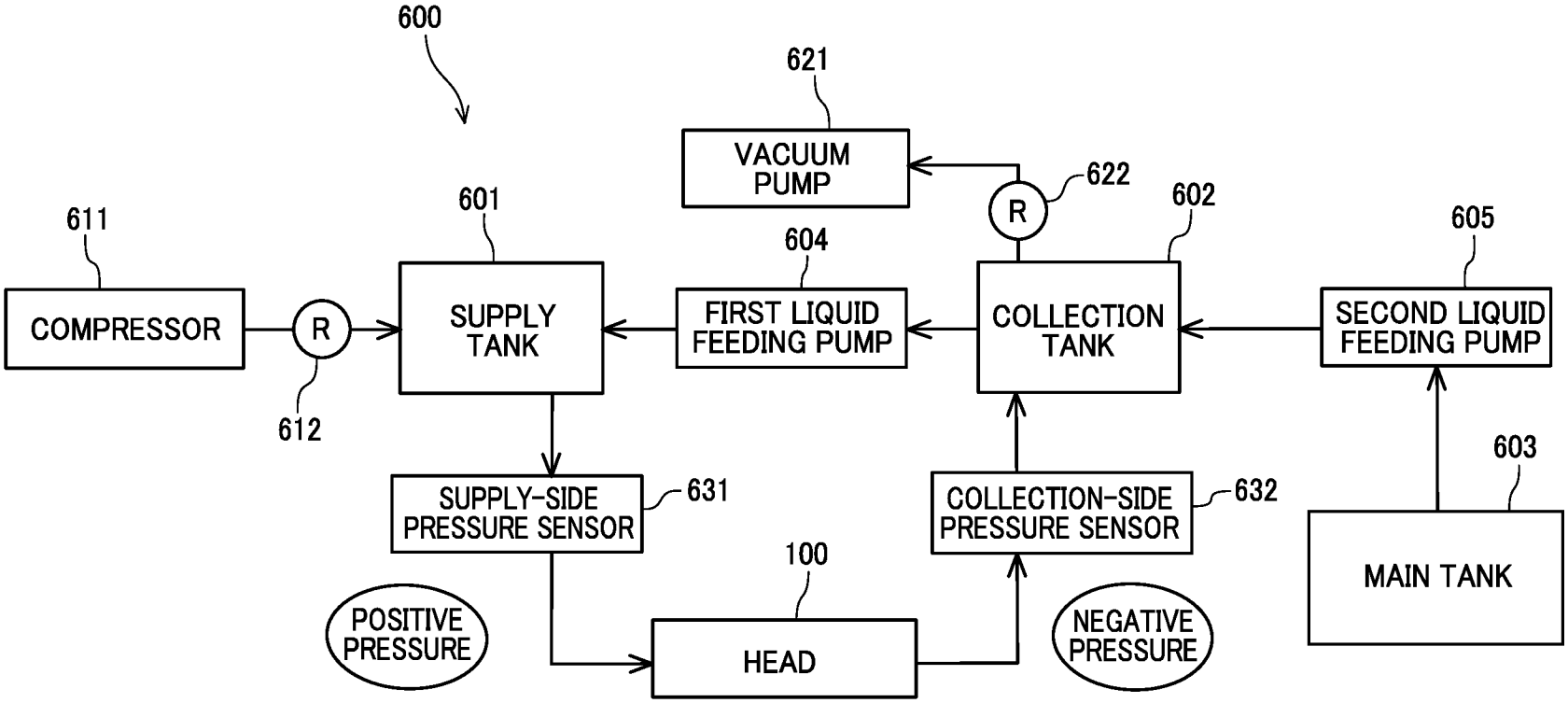
FIG. 13 is an explanatory block diagram of an exemplary liquid circulation device.

Next, an exemplary liquid circulation device will be described with reference to FIG. 13. FIG. 13 is an explanatory block diagram of the liquid circulation device. Note that, although only one head is illustrated here, in a case where a plurality of heads is arranged, supply-side liquid channels are connected to the supply side of the plurality of heads through a manifold, and collection-side liquid channels are connected to the collection side of the plurality of heads through a manifold.

A liquid circulation device 600 includes a supply tank 601, a collection tank 602, a main tank 603, a first liquid feeding pump 604, a second liquid feeding pump 605, a compressor 611, a regulator 612, a vacuum pump 621, a regulator 622, a supply-side pressure sensor 631, and a collection-side pressure sensor 632.

Here, the compressor 611 and the vacuum pump 621 generate a difference between pressure in the supply tank 601 and pressure in the collection tank 602.

The supply-side pressure sensor 631 located between the supply tank 601 and the head 100, is connected to the supply-side liquid channel linking with a supply port 71 of the head 100. The collection-side pressure sensor 632 located between the head 100 and the collection tank 602, is connected to the collection-side liquid channel linking with a collection port 72 of the head 100.

One end of the collection tank 602 is connected to the supply tank 601 through the first liquid feeding pump 604. The other end of the collection tank 602 is connected to the main tank 603 through the second liquid feeding pump 605.

This arrangement allows a circulation channel for circulating the liquid, in which the liquid flowed from the supply tank 601 into the head 100 through the supply port 71, is collected from the collection port 72 to the collection tank 602, and the first liquid feeding pump 604 feeds the liquid from the collection tank 602 to the supply tank 601.

Here, the supply tank 601 linked with the compressor 611, is controlled such that the supply-side pressure sensor 631 detects predetermined positive pressure. Meanwhile, the collection tank 602 linked with the vacuum pump 621, is controlled such that the collection-side pressure sensor 632 detects predetermined negative pressure.

This arrangement enables the liquid to circulate through the head 100 with the negative pressure of meniscus maintained constant.

When the liquid is discharged from the nozzles 4 of the head 100, the amount of the liquid decreases in each of the supply tank 601 and the collection tank 602. Thus, the liquid is appropriately replenished from the main tank 603 to the collection tank 602 with the second liquid feeding pump 605.

Note that the timing of liquid replenishment from the main tank 603 to the collection tank 602, can be controlled on the basis of a detected result of a level sensor provided in the collection tank 602, for example, when the level of the liquid in the collection tank 602 falls below a predetermined height.

Figure 14:
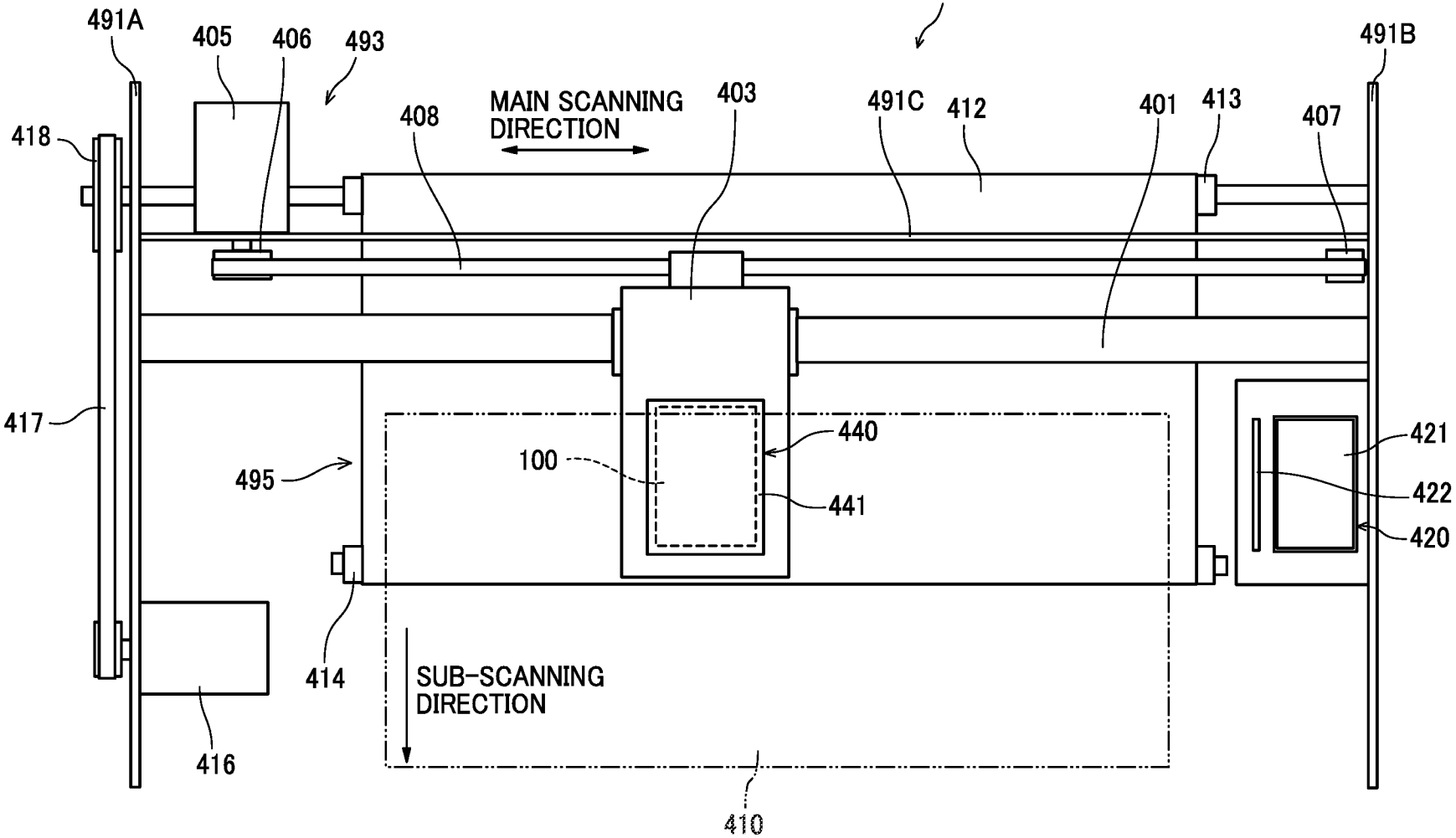
FIG. 14 is an explanatory plan view of a main part of another exemplary liquid discharge apparatus according to the present disclosure.
Figure 15:
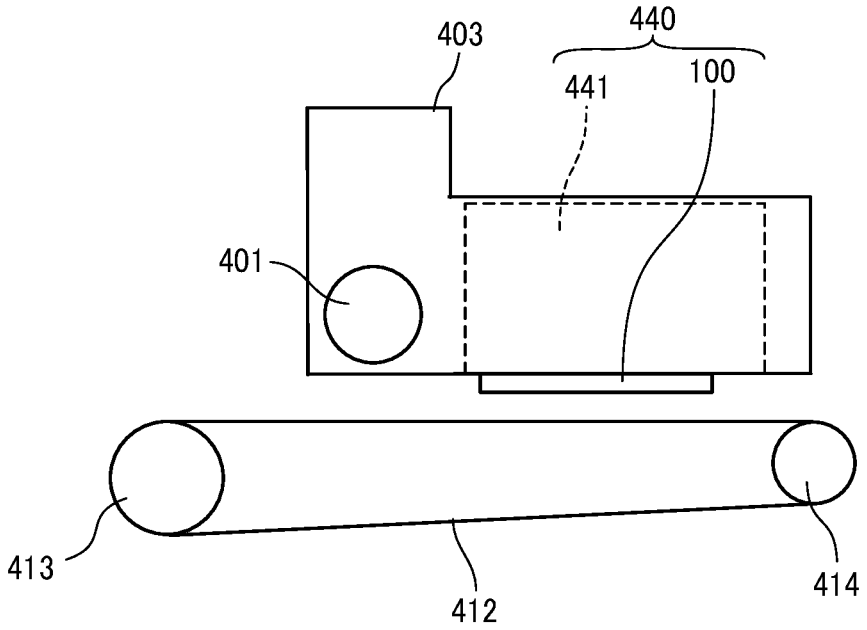
FIG. 15 is an explanatory side view of the main part of the liquid discharge apparatus.

Next, a printing apparatus that is another exemplary liquid discharge apparatus according to the present disclosure, will be described with reference to FIGS. 14 and 15. FIG. 14 is an explanatory plan view of a main part of the printing apparatus. FIG. 15 is an explanatory side view of the main part of the printing apparatus.

A printing apparatus 500, which is a serial head apparatus, reciprocates a carriage 403 in a main scanning direction with a main scanning movement mechanism 493. The main scanning movement mechanism 493 includes a guide member 401, a main scanning motor 405, and a timing belt 408. The guide member 401 bridged across a left side plate 491A and a right side plate 491B, retains the carriage 403 movably. The main scanning motor 405 reciprocates the carriage 403 in the main scanning direction through the timing belt 408 stretched across a driving pulley 406 and a driven pulley 407.

The carriage 403 is equipped with a liquid discharge device 440 including a head 100 according to the present disclosure integrally formed with a head tank 441. The head 100 of the liquid discharge device 440 discharges liquids for respective colors of yellow (Y), cyan (C), magenta (M), and black (K). The head 100 includes a nozzle array including a plurality of nozzles disposed in the sub-scanning direction orthogonal to the main scanning direction, the discharge direction of the nozzles facing downward.

The head 100 is circulation-supplied with the liquid for a required color in connection with the liquid circulation device 600 described above.

The printing apparatus 500 includes a conveyance mechanism 495 that conveys a paper sheet 410. The conveyance mechanism 495 includes a conveyance belt 412 that is a conveyer and a sub-scanning motor 416 that drives the conveyance belt 412.

The conveyance belt 412 adsorbs and conveys the paper sheet 410 at a position opposed to the head 100. The conveyance belt 412, which is an endless belt, is stretched across a conveyance roller 413 and a tension roller 414. The adsorption can be performed by electrostatic adsorption or air suction.

When the sub-scanning motor 416 drives the conveyance roller 413 to rotate through a timing belt 417 and a timing pulley 418, the conveyance belt 412 moves circumferentially in the sub-scanning direction.

Furthermore, a maintenance mechanism 420 that maintains the head 100, is disposed laterally to the conveyance belt 412, on one side in the main scanning direction of the carriage 403.

For example, the maintenance mechanism 420 includes a cap member 421 that caps the nozzle face of the head 100 (face on which the nozzles are formed) and a wiper member 422 that wipes the nozzle face.

The main scanning movement mechanism 493, the maintenance mechanism 420, and the conveyance mechanism 495 are attached to a casing including the side plates 491A and 491B and a back plate 491C.

In the printing apparatus 500 having the configuration, the paper sheet 410 is fed and adsorbed onto the conveyance belt 412. Then, the conveyance belt 412 moves circumferentially to convey the paper sheet 410 in the sub-scanning direction.

The head 100 is driven in accordance with an image signal while the carriage 403 is moving in the main scanning direction. Thus, the liquid is discharged onto the paper sheet 410 stopping to form an image.

Thus, with the head according to the present disclosure, the apparatus can form a high-quality image reliably.

Figure 16:
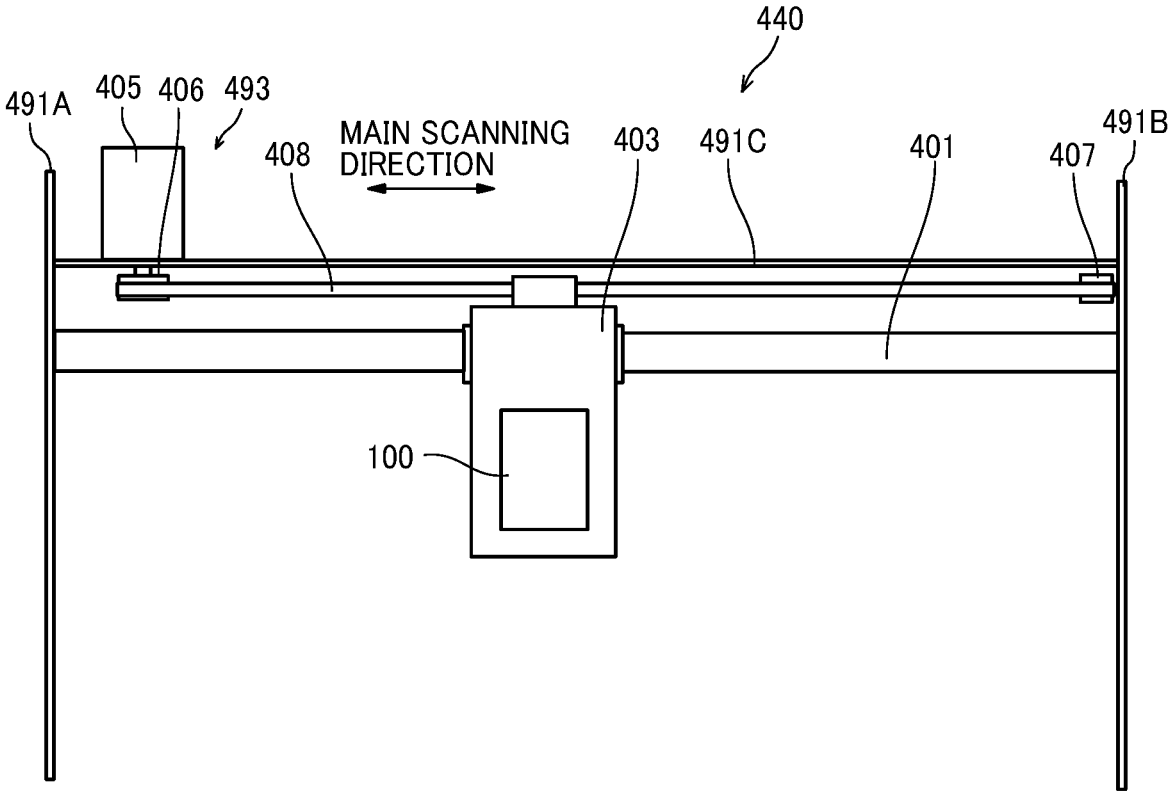
FIG. 16 is an explanatory plan view of a main part of another exemplary liquid discharge device according to the present disclosure.

Next, another exemplary liquid discharge device according to the present disclosure, will be described with reference to FIG. 16. FIG. 16 is an explanatory plan view of a main part of the liquid discharge device.

From the constituent members of the liquid discharge apparatus described above, a liquid discharge device 440 includes a casing including the side plates 491A and 491B and the back plate 491C, and the main scanning movement mechanism 493, the carriage 403, and the head 100.

Note that, for example, the maintenance mechanism 420 described above can be further attached to the side plate 491B of the liquid discharge device 440.

Thus, the head 100 and at least one of the head tank 441 storing liquid to be supplied to the head 100, the carriage 403 on which the head 100 is mounted, a supply mechanism (liquid circulation device 600, for example) to supply liquid to the head 100, the maintenance mechanism 420 to maintain the head 100, and the main scanning movement mechanism 493 to move the head 100 in the main scanning direction form the liquid discharge device as a single unit.

Figure 17:
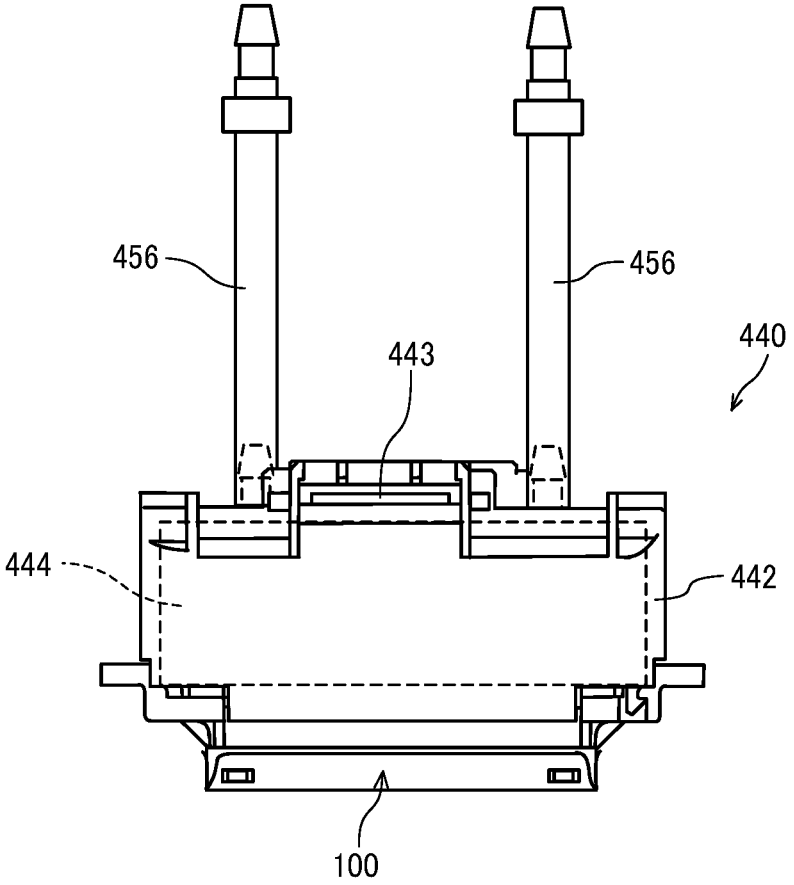
FIG. 17 is an explanatory front view of still another exemplary liquid discharge device according to the present disclosure.

Next, still another exemplary liquid discharge device according to the present disclosure, will be described with reference to FIG. 17. FIG. 17 is an explanatory front view of the liquid discharge device.

A liquid discharge device 440 includes a head 100 to which a channel component 444 is attached, and tubes 456 connected to the channel component 444.

Note that the channel component 444 is disposed inside a cover 442. A head tank 441 can be included instead of the channel component 444. A connector 443 that makes an electrical connection to the head 100, is provided at the upper portion of the channel component 444.

In the present application, liquid to be discharged is not particularly limited as long as the liquid has a viscosity or surface tension allowing the liquid to be discharged from the head. Preferably, the viscosity is not greater than 30 mPa·s under ordinary temperature and ordinary pressure or by heating or cooling. More specifically, examples of the liquid include a solution, a suspension, and an emulsion that contain a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant. Such a solution, a suspension, or an emulsion can be used for inkjet ink, surface treatment solution, a liquid for forming constituent elements of electronic element or light-emitting element or a resist pattern of electronic circuit, or a material solution for three-dimensional fabrication.

Examples of an energy generation source for discharging the liquid include a piezoelectric actuator (a laminated piezoelectric element or a thin-film piezoelectric element), a thermal actuator that employs an electrothermal conversion element, such as a heating resistor, and an electrostatic actuator including a diaphragm and opposed electrodes.

The "liquid discharge device" includes the liquid discharge head integrated with a functional component or mechanism. An example of the "liquid discharge device" is an assembly of components relating to liquid discharge. For example, the "liquid discharge device" includes a combination of the liquid discharge head with at least one of a head tank, a carriage, a supply mechanism, a maintenance mechanism, a main scanning movement mechanism, and a liquid circulation device.

Here, examples of the integration include mutually securing of the liquid discharge head and the functional component or mechanism through fastening, bonding, or engaging, and movably retention of one to the other. The liquid discharge head and the functional component or mechanism may be provided mutually detachably.

For example, as the liquid discharge device, provided is the integration of the liquid discharge head with the head tank. For the integration, the liquid discharge head and the head tank are connected mutually through a tube. Here, a unit including a filter can be added between the head tank and the liquid discharge head of the liquid discharge device.

As the liquid discharge device, provided is the integration of the liquid discharge head with the carriage.

As the liquid discharge device, provided is the integration of the liquid discharge head with the main scanning movement mechanism, in which the liquid discharge head is retained movably by a guide member included in part of the main scanning movement mechanism. Provided is the integration of the liquid discharge head, the carriage, and the main scanning movement mechanism.

As the liquid discharge device, provided is the integration of the liquid discharge head, the carriage, and the maintenance mechanism, in which a cap member included in part of the maintenance mechanism is secured to the carriage having the liquid discharge head attached.

As the liquid discharge device, provided is the integration of the liquid discharge head and the supply mechanism, in which a tube is connected to the liquid discharge head having the head tank or a channel component attached. Through the tube, the liquid in a liquid storage source is supplied to the liquid discharge head. The main scanning movement mechanism includes the guide member as a single body. The supply mechanism includes the tube as a single body and a loader as a single body.

An example of the "liquid discharge apparatus" is an apparatus including the liquid discharge head or the liquid discharge device, the apparatus being to drive the liquid discharge head to discharge the liquid. Examples of the liquid discharge apparatus include an apparatus configured to discharge liquid to an object to which the liquid can adhere, and an apparatus that discharges liquid into gas or liquid.

The "liquid discharge apparatus" can include not only units involved in feeding, conveyance, and paper ejection of the object to which liquid can adhere, but also a preprocessing device and a postprocessing device.

Examples of the "liquid discharge apparatus" include: an image forming apparatus that discharges ink to form an image on a paper sheet; and a solid fabrication apparatus (three-dimensional fabrication apparatus) that discharges a fabrication liquid to a powder layer including powder formed in layers in order to fabricate a solid fabrication object (three-dimensional fabrication object).

The "liquid discharge apparatus" is not limited to visualization of a meaningful image including a character or a figure, with the discharged liquid. For example, formation of a pattern having no meaning and shaping of the pattern to a three-dimensional image, are included.

The "object to which liquid can adhere" described above means, for example, an object to which liquid can adhere at least temporarily, the liquid being to adhere to and to fix on the object or to adhere to and to permeate the object. Specific examples include recording media, such as a paper sheet, recording paper, a recording paper sheet, film, and cloth, electronic components, such as an electronic substrate and a piezoelectric element, and media, such as a powder layer (granular layer), an organ model, and a testing cell. Unless otherwise particularly limited, any object to which liquid adheres, is included.

The material of the "object to which liquid can adhere" may be any material, such as paper, thread, fiber, fabric cloth, leather, metal, plastic, glass, wood, or ceramics as long as liquid can adhere to at least temporarily.

The "liquid discharge apparatus" may be, but is not limited to, an apparatus that relatively moves the liquid discharge head and the object to which liquid can adhere. Specific examples include a serial head apparatus that moves the liquid discharge head and a line head apparatus that does not move the liquid discharge head.

Further examples of the "liquid discharge apparatus" include a treatment liquid coating apparatus that discharges a treatment liquid onto a paper sheet in order to coat the treatment liquid on the surface of the paper sheet for reforming of the surface of the paper sheet, and an injection granulation apparatus that sprays a composition liquid including raw material dispersed in a solution, through a nozzle, to granulate fine particles of the raw material.

Note that the terms "image formation," "recording," "character printing," "image printing," "printing," and "shaping" are used as synonyms in the present application.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head, comprising:

a plurality of nozzles to discharge liquid;

a plurality of pressure chambers respectively communicating with the plurality of nozzles;

a plurality of individual flow paths respectively communicating with the plurality of pressure chambers; and a common flow path communicating with the plurality of individual flow paths, wherein each individual flow path includes a first flow path portion and a second flow path portion each having a fluid resistance higher than a fluid resistance of a pressure chamber of the plurality of pressure chambers that communicates with the individual flow path, and a third flow path portion disposed between the first flow path portion and the second flow path portion, the third flow path portion having a fluid resistance lower than the fluid resistance of the first flow path portion and the third resistance of the second flow path portion.

2. The liquid discharge head of claim 1, wherein the fluid resistance of the first flow path portion is equal to the fluid resistance of the second flow path portion.

3. The liquid discharge head of claim 1, wherein the fluid resistance of the first flow path portion is not equal to the fluid resistance of the second flow path portion.

4. The liquid discharge head of claim 1, wherein a width of the first flow path portion and a width of the second flow path portion are each smaller than a width of the pressure chamber and a width of the third flow path portion.

5. The liquid discharge head of claim 1, wherein a height of the first flow path portion and a height of the second flow path portion are each smaller than a height of the pressure chamber and a height of the third flow path portion.

6. The liquid discharge head of claim 1, further comprising:

a first plate member forming the pressure chamber, the first flow path portion, and a part of the third flow path portion; and a second plate member forming the second flow path portion and a remaining part of the third flow path portion.

7. A liquid discharge device, comprising:

the liquid discharge head according to claim 1.

8. The liquid discharge device of claim 7, further comprising at least one of:

a head tank to store the liquid to be supplied to the liquid discharge head;

a carriage to mount the liquid discharge head;

a supply device to supply the liquid to the liquid discharge head;

a maintenance device to maintain the liquid discharge head; and a drive device to move the carriage in a main scanning direction, together with the liquid discharge head, to form a single unit.

9. A liquid discharge apparatus, comprising:

the liquid discharge device according to claim 8.

10. The liquid discharge device of claim 7, wherein the fluid resistance of the first flow path portion is equal to the fluid resistance of the second flow path portion.

11. The liquid discharge device of claim 7, wherein the fluid resistance of the first flow path portion is not equal to the fluid resistance of the second flow path portion.

12. The liquid discharge device of claim 7, wherein a width of the first flow path portion and a width of the second flow path portion are each smaller than a width of the pressure chamber and a width of the third flow path portion.

13. The liquid discharge device of claim 7, wherein a height of the first flow path portion and a height of the second flow path portion are each smaller than a height of the pressure chamber and a height of the third flow path portion.

14. The liquid discharge device of claim 7, further comprising:

a first plate member forming the pressure chamber, the first flow path portion, and a part of the third flow path portion; and a second plate member forming the second flow path portion and a remaining part of the third flow path portion.

15. The liquid discharge apparatus of claim 9, wherein the fluid resistance of the first flow path portion is equal to the fluid resistance of the second flow path portion.

16. The liquid discharge apparatus of claim 9, wherein the fluid resistance of the first flow path portion is not equal to the fluid resistance of the second flow path portion.

17. The liquid discharge apparatus of claim 9, wherein a width of the first flow path portion and a width of the second flow path portion are each smaller than a width of the pressure chamber and a width of the third flow path portion.

18. The liquid discharge apparatus of claim 9, wherein a height of the first flow path portion and a height of the second flow path portion are each smaller than a height of the pressure chamber and a height of the third flow path portion.

19. The liquid discharge apparatus of claim 9, further comprising:

a first plate member forming the pressure chamber, the first flow path portion, and a part of the third flow path portion; and a second plate member forming the second flow path portion and a remaining part of the third flow path portion.

* * * * *